US005180106A

United States Patent [19]

Handfield

[11] Patent Number: 5,180,106

[45] Date of Patent: Jan. 19, 1993

[54] SNOW MAKING MACHINE

[75] Inventor: Louis Handfield, Quebec, Canada

[73] Assignee: Turbines S.M.S. Inc., Canada

[21] Appl. No.: 688,440

[22] Filed: Apr. 22, 1991

[30] Foreign Application Priority Data

Apr. 24, 1990 [CA] Canada ..... 2015259

[51] Int. Cl.[5] ..... F25C 3/04

[52] U.S. Cl. ..... 239/14.2

[58] Field of Search ..... 239/2.2, 14.2, 77, 78; 62/74

[56] References Cited

U.S. PATENT DOCUMENTS

| | | | |
|---|---|---|---|
| 2,571,069 | 10/1951 | Shearman . | |
| 2,886,249 | 5/1959 | Sidlow . | |
| 3,301,485 | 1/1967 | Tropeano et al. . | |
| 3,387,791 | 6/1968 | Allenbaugh. Jr. . | |
| 3,567,117 | 3/1971 | Eustis . | |
| 3,654,446 | 2/1972 | Patten . | |
| 3,945,567 | 3/1976 | Rambach . | |
| 3,948,442 | 4/1976 | Dewey . | |
| 3,964,682 | 6/1976 | Tropeano et al. . | |
| 3,979,061 | 9/1976 | Kircher . | |
| 4,004,732 | 1/1977 | Hanson . | |
| 4,083,492 | 4/1978 | Dewey . | |
| 4,105,161 | 8/1978 | Kircher et al. . | |
| 4,222,519 | 9/1980 | Kircher et al. | 239/14.2 |
| 4,223,836 | 9/1980 | Eager . | |
| 4,353,504 | 10/1982 | Girardin et al. . | |
| 4,475,688 | 10/1984 | Hodges . | |
| 4,493,457 | 1/1985 | Dilworth et al. | 239/14.2 |
| 4,516,723 | 5/1985 | Hesse . | |
| 4,573,636 | 3/1986 | Dilworth et al. . | |
| 4,634,050 | 1/1987 | Shippee . | |
| 4,682,729 | 7/1987 | Doman et al. | 239/14.2 |
| 4,711,395 | 12/1987 | Handfield | 239/14.2 |
| 4,793,554 | 12/1988 | Kraus et al. . | |
| 4,813,598 | 3/1989 | Kosik, Sr. et al. | 239/14.2 |

FOREIGN PATENT DOCUMENTS

| | | | |
|---|---|---|---|
| 1174064 | 9/1984 | Canada . | |
| 004803 | 10/1979 | European Pat. Off. . | |
| 0089590 | 9/1983 | European Pat. Off. . | |
| 1372024 | 8/1964 | France . | |
| 2371649 | 6/1978 | France . | |
| 2376384 | 7/1978 | France | 239/14.2 |
| 0951031 | 8/1982 | U.S.S.R. | 239/14.2 |
| 1317249 | 6/1987 | U.S.S.R. | 239/2.2 |
| WO86/05864 | 10/1986 | World Int. Prop. O. . | |

OTHER PUBLICATIONS

Sufag publication (1 sheet). Product commercially available more than one year before the filing date of this application.

Happy Snow publication (8 sheets). Products commercially available more than one year before the filing date of this application.

Areco publication (5 sheets). Product commercially available more than one year before the filing date of this application.

Hedco publication (9 sheets, pp. 99–107). Product commercially available in 1970.

Snowstream 320 publication (2 sheets, pp. 97 and 98). Product commercially available in 1968.

Boyne Snowmaker publication (3 sheets, pp. 94–96). Product commercially available more than one year before the filing date of this application.

*Primary Examiner*—Andres Kashnikow
*Assistant Examiner*—Karen B. Merritt
*Attorney, Agent, or Firm*—Larson and Taylor

[57] ABSTRACT

A device for producing an airborne stream of ice crystals, the device comprising an inner housing mounted within an outer housing to define therewith an air passage having a venturi-shaped zone. A flaring nozzle is mounted to an outlet end of the outer housing. A vaneaxial fan is mounted in the outer housing and cooperates with guide vanes extending between the inner and the outer housing to produce a substantially rectilinear air flow through the passage. A diffuser is mounted adjacent an outlet end of the inner housing for creating an annular and rectilinear stream of air surrounded by a diverging stream of air. A water nozzle and nucleators are mounted in the outlet end of the inner housing to produce water droplets sprayed in the air streams, which freeze to form an airborne stream of ice crystals.

56 Claims, 4 Drawing Sheets

SNOW MAKING MACHINE

The invention relates to a device for producing a stream of small ice crystals referred as artificial snow. The device will be referred to hereinafter as snow making machine.

An object of the invention is to improve upon existing snow making machines.

As embodied and broadly described herein, the invention provides a device for producing an airborne stream of ice crystals, said device comprising:

an elongated outer housing;

an elongated inner housing mounted within said outer housing, said housings defining therebetween an air passage having a venturi-shaped zone to cause a gradual increase of velocity of air flowing through said passage;

a flaring nozzle mounted to an outlet end of said outer housing;

a vaneaxial fan in said outer housing;

a plurality of guide vanes extending between said housing, said vaneaxial fan and said guide vanes constituting means for producing a high velocity, substantially rectilinear air flow through said passage;

a diffuser adjacent to an outlet end of said inner housing for creating a substantially annular and substantially rectilinear stream of air at said outlet end of said inner housing, said diffuser and said flaring nozzle creating an outer, annular, diverging stream of air generally coaxial with said substantially rectilinear stream of air;

a water nozzle for spraying a diverging stream of water into said streams of air; and a plurality of nucleators in the outlet end of said inner housing for spraying fine water droplets downstream of the outlet end of said inner housing, said fine water droplets forming nuclei to induce ice crystals formation whereby, temperature permitting, water drops of said stream of water adhere to said nuclei to form ice crystals.

Spiral movement of an airstream in a housing will result in high friction losses and more turbulence at the exit from the fan housing. Moreover, regardless of whether the water is sprayed from the center or the periphery of the airstream, turbulence and spiral motion create a centrifugal force which effects air velocity and causes water droplets to leave the plume prematurely. By using a vaneaxial fan and guide vanes downstream of the fan blades, tangential velocity is converted into static pressure to provide a rectilinear flow.

The exit velocity distribution of the air and water is of prime importance for a better effective throw of the air/water plume. The projection of air from round openings is related to the average exit velocity and coefficient of discharge at the face of the air supply opening.

Air/water plume development is largely dependent upon the exit conditions controlling the mixing layer region and some of the transition flow region.

The main processes occurring in the plume after leaving the discharge opening are, (1) the mixing and consequently the redistribution of momentum between the plume airflow and entrained ambient air and (2) the deceleration of the mixed plume fluid by the increasingly important air resistance.

Regardless of the type of opening, the jet will tend to assume a circular shape, and the stream will eventually become an expanding cone with a solid angle of 20° and 24° downstream of the vena contracta and potential core region.

As embodied and broadly described herein, the invention provides a device for producing an airborne stream of ice crystals, said device comprising:

an elongated outer housing;

an elongated inner housing mounted within said outer housing, said housing defining therebetween an air passage having a venturi-shaped zone to cause a gradual increase of velocity of air flowing through said passage;

a fan in said outer housing, said fan generating a flow of air through said passage which egresses through an outlet end of said outer housing as a high velocity air stream;

a water nozzle for spraying a diverging stream of water into said air stream; and a nucleator in an outlet end of said inner housing for spraying fine water droplets within said streams, said fine water droplets forming nuclei to induce ice crystals formation whereby, temperature permitting, water drops of said stream of water adhere to said nuclei to form ice crystals.

As embodied and broadly described herein, the invention provides a device for producing an airborne stream of ice crystals, said device comprising:

an elongated outer housing;

an elongated inner housing mounted within said outer housing, said housings defining therebetween an air passage;

a fan in said outer housing, said fan generating a flow of air through said passage which egresses from an outlet end of said outer housing as a high velocity air stream;

a water nozzle for spraying a diverging stream of water into said air stream; and a nucleator in an outlet end of said inner housing for spraying fine water droplets within said streams, said fine water droplets forming nuclei to induce ice crystals formation, whereby, temperature permitting, water drops of said stream of water adhere to said nuclei to form ice crystals.

As embodied and broadly described herein, the invention provides a device for producing an airborne stream of ice crystals, said device comprising:

an elongated outer housing;

an elongated inner housing mounted within said outer housing, said housings defining therebetween an air passage having a venturi-shaped zone to cause a gradual increase of velocity of air flowing through said passage;

a fan in said outer housing, said fan generating a flow of air through said passage which egresses from an outlet end of said outer housing as a high velocity air stream;

a water nozzle for spraying a diverging stream of water into said air stream; and a nucleator for spraying fine water droplets within said streams, said fine water droplets forming nuclei to induce ice crystals formation whereby, temperature permitting, water drops of said stream of water adhere to said nuclei to form ice crystals.

The invention will be described in greater detail with reference to the accompanying drawings, which illustrate a preferred embodiment of the invention, and wherein.

Figure 1:
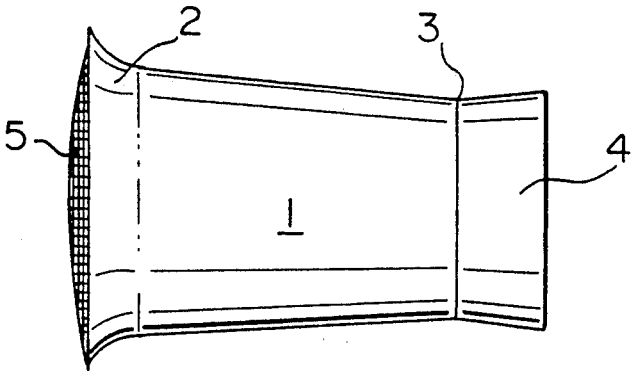
FIG. 1 is a side view of a snow making machine in accordance with the present invention.
Figure 2:
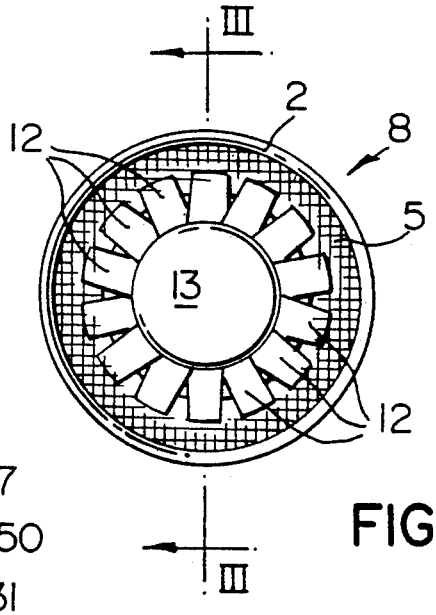
FIG. 2 is an end view of the snow making machine as seen from the left of FIG. 1.
Figure 3:
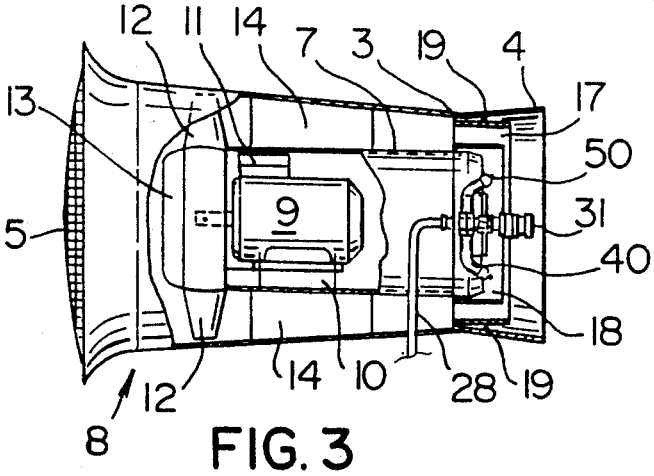
FIG. 3 is a longitudinal, partly sectional view taken generally along the line III—III of FIG. 2.
Figure 4:
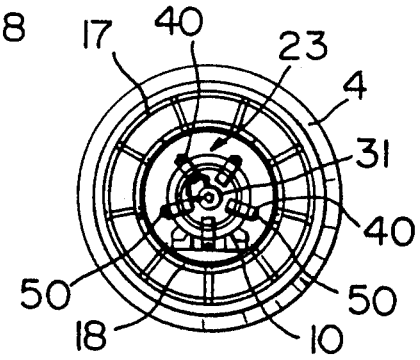
FIG. 4 is an end view of the snow making machine as seen from the right of FIG. 1.
Figures 5, 7, 8:
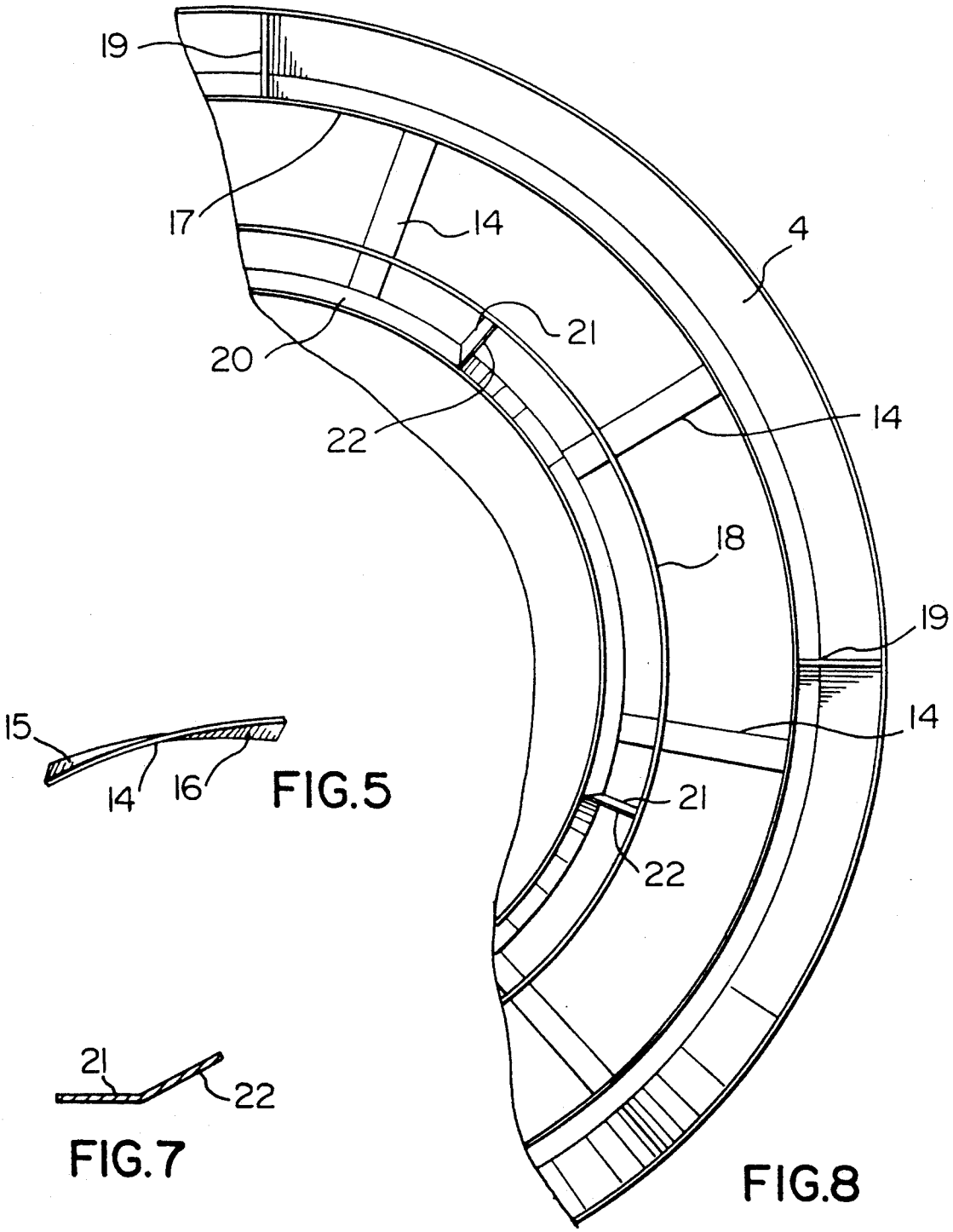
FIG. 5 is a plan view of a vane used in the machine of FIGS. 1 to 4.
Figure 6:
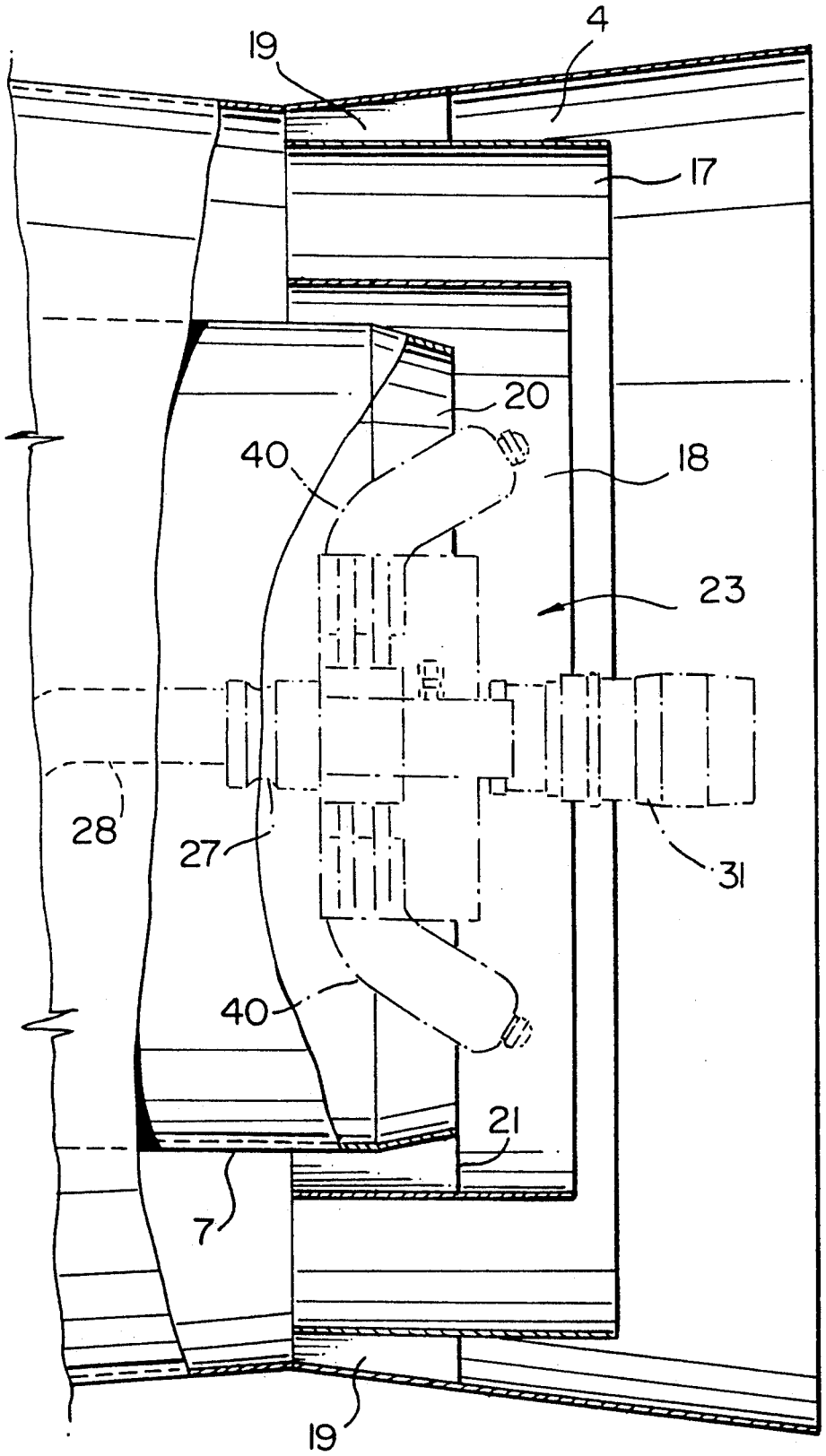
Figure 10:
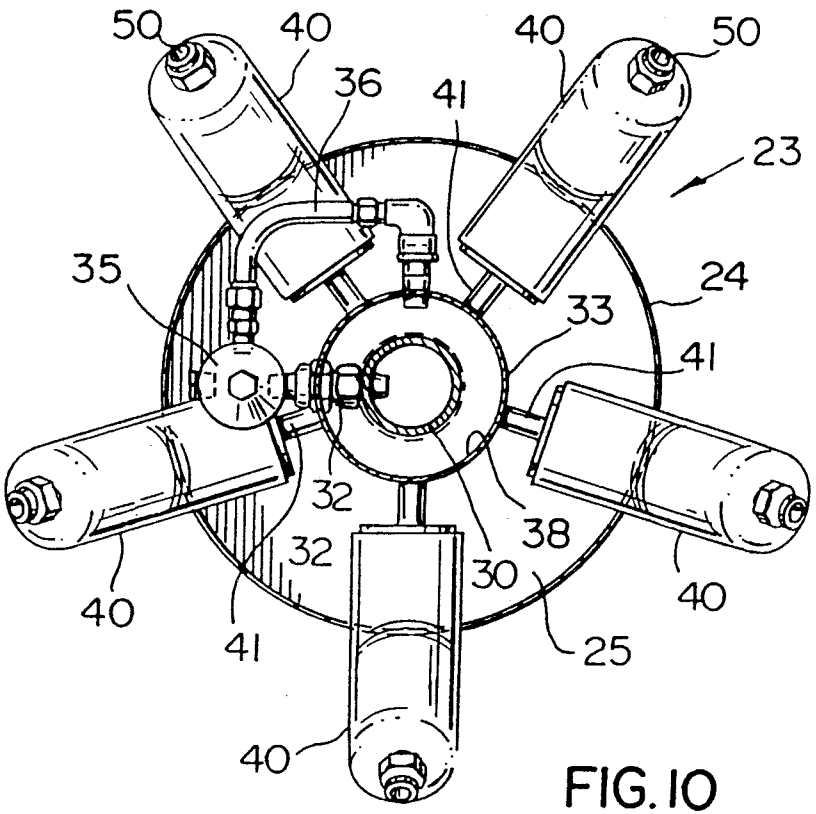
Figure 9:
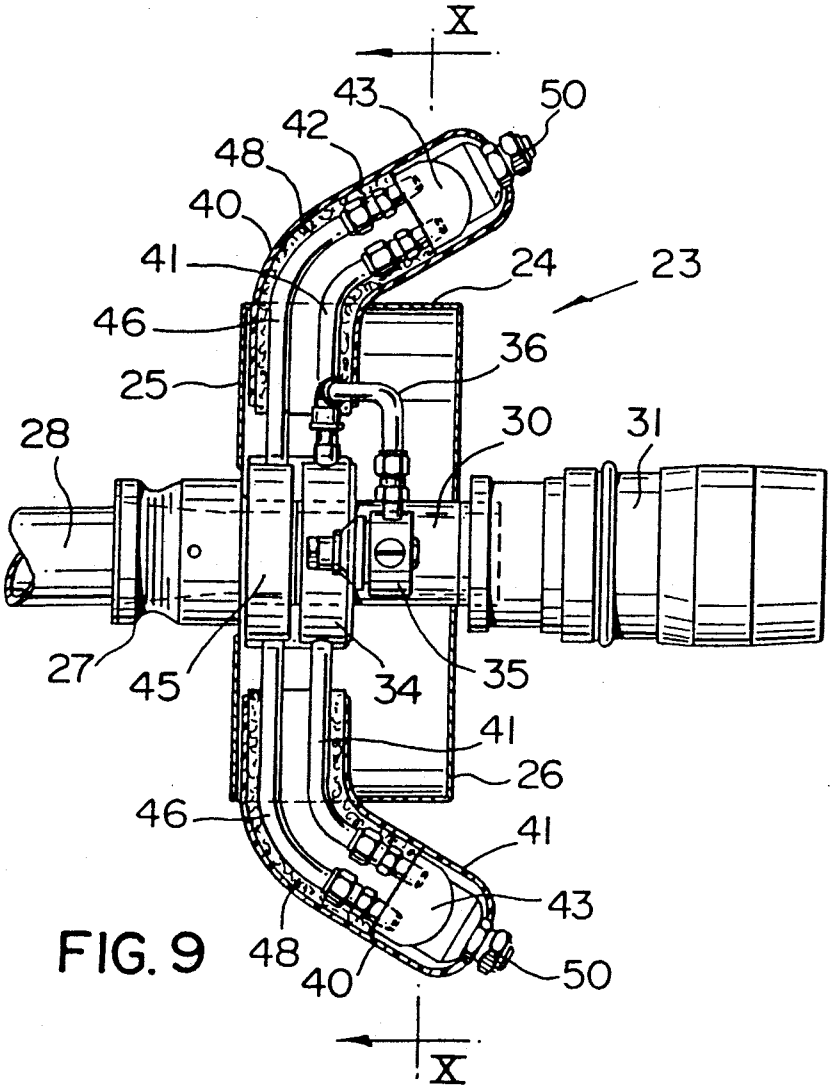

FIG. 6, which appears on the third sheet of drawings is a longitudinal sectional view of the outlet end of the machine of FIG. 1 on a larger scale;

FIG. 7 is an end view of a vortex strip between diffuser blades illustrated in FIG. 6;

FIG. 8 is an enlarged end view of a portion of the outlet end of the machine of FIG. 1;

FIG. 9 is a longitudinal sectional view of a manifold, turbine and nucleators used in the machine of FIG. 1; and FIG. 10 is a cross-section taken generally along line X—X of FIG. 9.

Referring to FIGS. 1 to 4, the snow making machine of the present invention includes an elongated, tubular outer housing 1, which tapers gently from an inlet bell 2 to a constriction 3, and then flares outwardly to define a tubular, frusto-conical discharge nozzle 4. The converging section of the housing 1 and the nozzle 4 define a venturi-shaped zone. A protective screen 5 is provided on the open inlet of the bell 2.

A cylindrical inner housing 7 is mounted in the outer housing 1 downstream (in the direction of air travel) of the inlet bell 2. The housing carries a vaneaxial fan generally indicated at 8, including an electric motor 9, the base 10 of which is mounted on the bottom of the housing. An electrical connection box 11 is provided on the motor 9 for connecting the latter to a source of electrical power (not shown). Blades 12 extend radially outwardly from an impeller cover 13 on the leading or inlet end of the housing 7. A plurality of guide vanes 14 extend radially between the outer and inner housings 1 and 7, respectively downstream of the blades 12. There are nine to eleven vanes 14 spaced equidistant apart around the periphery of the inner housing 7. The vanes 14 have the shape shown in FIG. 5 and are intended to produce a substantially rectilinear airstream in the passage defined between the outer and inner housing 1 and 7. For such purpose, each vane 14, which is trapezoidal when viewed from the side, includes a leading end which is inclined with respect to the desired longitudinal air flow, and a trailing end 16 inclined outwardly from the inner housing 7, but more or less aligned with the intended direction of air flow. The guide vanes 14 are spaced from the trailing edges of the blades 12 by two or four inches and extend at least one half of the distance from the trailing edges of the blades 12 to the outlet end of the housing 1.

As best shown in FIGS. 6 to 8, outer and inner cylindrical diffuser plates 17 and 18, respectively are provided in the discharge nozzle 4 immediately downstream of the constriction 3, The outer diffuser plate 17 is connected to the discharge nozzle 4 by strips 19 spaced equidistant apart around the periphery of the plate 17. The inner diffuser plate 18 is connected to the tapered trailing end 20 of the inner housing 7 by connectors or vortex strips 21. The strips 21 (FIG. 7) have trailing ends 22 inclined into the path of air flowing through the passage between the plate 18 and the end 20 of the inner housing 7.

A manifold casing generally indicated at 23 is mounted in the trailing end 20 of the inner housing 7. The casing 23 includes a cylindrical side wall 24, a circular inner or leading end wall 25 and an outer or training end wall 26. A connector 27 on the leading end wall 25 connects the casing 23 to a source of water under pressure. The water enters the outer housing 1, the inner housing 7 and finally the casing 23 via an inlet pipe 28. The main portion of the water passes through a tube 30 extending through the center of the casing 23 to a nozzle defined by a turbine 31. The turbine 31, which is similar to the turbine used in the inventor's U.S. Pat. No. 4,711,395, discharges a high pressure stream of water droplets centrally of the discharge nozzle 4 for mixing with air from the fan 8 and ice nuclei.

The remainder of the water in the tube 30 is diverted through a connector 32 in a cylindrical side wall 33 of a water manifold 34 to a pressure regulator 35, and then through a tube 36 into the inner manifold chamber 38 between the wall 33 and the tube 30. The manifold 34 is connected to a plurality of nucleators 40 by tubes 41. The tubes 41 extend through a nucleator casing 42 to a mixing head 43. In the head 43, the water is mixed with air under pressure from a compressed air manifold 45 (FIG. 9). The air manifold 45 is connected to a source of air under pressure by a pipe (not shown) extending through the outer and inner housing 1 and 7, respectively. The air passes through the manifold 45 and tubes 46 to the mixing head 43. Insulation 48 is provided on the interior of the casing 42 for reducing the likelihood of freezing of the tubes 41. The mixture of water and air under pressure is discharged from the nucleators 40 via pneumatic atomizing nozzles 50.

In operation, an annular, rectilinear stream of air is created between the outer and inner housings 1 and 7, respectively using the fan 8 and the vanes 14. The air stream passes between the diffuser plates 17 and 18 and it is split into cylindrical layers. At least a portion of the outermost layer passing between the outer housing 1 and the diffuser plates tends to adhere to the discharge nozzle 4 because of the Coanda Effect. Depending upon the gap between the outer housing 1 and the diffuser plates, and the angle of the discharge nozzle 4, the outer layer of air spontaneously attaches to the inner surface of the discharge nozzle, i.e. the outer layer slows down, producing an annular, diverging flow from the free outlet end of the nozzle 4. Some of the air passes between the inner diffuser plate 18 and the inner housing 7, forming a substantially annular and rectilinear stream for mixing with the fine water droplets discharged from the nucleators 40 and with the water from the turbine 31. Temperature permitting, the resulting mixture forms snow at a distance from the outlet end of the machine.

By providing a substantially rectilinear air flow and transforming the tangential velocity of the air into static pressure using guide vanes downstream of the fan blades, and increasing the air mass velocity through a venturi shaped area, high inertia velocity air is provided without additional energy. This is explained by the well known Bernouilli Theorem.

The enclosed section of fan housing permits an increase in air (pressure) velocity while static pressure decreases with constant total pressure. Static pressure becomes negative and permits the velocity pressure to exceed the total pressure.

Because the velocity of the outer periphery of the annular airstream is low, less ambient air is entrained and the effective throw of the airstream is increased.

The air passing between the inner diffuser ring and the inner housing is pumped in the vacuum gap created between the annular stream and the water spray.

The Coanda Effect is the phenomenon of adherence of a fluid jet to a solid surface. The Coanda Effect occurs when a sufficiently long plate is brought near a fluid jet flowing parallel to the plate. When the plate bends, the jet bends and attaches to the plate. Applying this phenomenon to the annular stream of air with a sufficiently long diverging cone, results in the creation of a diverging annular stream of air.

I claim:

1. A device for producing an airborne stream of ice crystals, said device comprising:

an elongated outer housing;

an elongated inner housing mounted within said outer housing, said housings defining therebetween an air passage having a venturi-shaped zone to cause a gradual increase of velocity of air flowing through said passage;

a flaring nozzle mounted to an outlet end of said outer housing;

a vaneaxial fan in said outer housing;

a plurality of guide vanes extending between said housing, said vaneaxial fan and said guide vanes constituting means for producing a high velocity, substantially rectilinear air flow through said passage;

a diffuser adjacent to an outlet end of said inner housing for creating a substantially annular and substantially rectilinear stream of air at the outlet end of said inner housing, said diffuser and said flaring nozzle creating an outer, annular, diverging stream of air generally coaxial with said substantially rectilinear stream of air;

a water nozzle of spraying a diverging stream of water into said streams of air; and a plurality of nucleators in the outlet end of said inner housing for spraying fine water droplets downstream of the outlet end of said inner housing, said fine water droplets forming nuclei to induce ice crystals formation whereby, temperature permitting, water drops of said stream of water adhere to said nuclei to form ice crystals.

2. A device as defined in claim 1, wherein said guide vanes are located a short distance downstream from blades of said vaneaxial fan, said guide vanes extending at least one half of the distance between said blades and said venturi-shaped zone.

3. A device as defined in claim 2, wherein said diffuser includes a first generally annular plate proximate the outlet end of said inner housing, and a second generally annular plate proximate said venturi-shaped zone.

4. A device as defined in claim 3, wherein said first plate overlaps a trailing end of said inner housing and terminates beyond said plurality of nucleators in a direction of air flow, said second plate overlapping said first plate and extending beyond a trailing end thereof upstream of a discharge end of said water nozzle.

5. A device according to claim 1, including manifold means in the outlet end of said inner housing for separately receiving water and air under pressure, said manifold means carrying said water nozzle and said plurality of nucleators.

6. A device according to claim 5, wherein said manifold means includes a water manifold for receiving water under pressure and feeding the water to said plurality of nucleators and an air manifold for receiving air under pressure and feeding the air to said plurality of nucleators.

7. A device according to claim 6, wherein said manifold means includes a conduit extending through said water manifold and carrying said water nozzle on one end thereof, said conduit receiving water under pressure for discharge through said water nozzle and into said water manifold.

8. A device according to claim 7, wherein said manifold means includes a cylindrical wall coaxial with said conduit defining said water manifold, a pressure regulator outside said wall for receiving water from said conduit, and a return line for feeding water from said pressure regulator into said water manifold for distribution to said plurality of nucleators.

9. A device according to claim 1, wherein said housings have a generally tubular shape.

10. A device according to claim 1, wherein said outer housing has a converging section which forms said venturi-shaped zone in conjunction with said flaring nozzle.

11. A device according to claim 1 wherein said water nozzle is mounted in said inner housing.

12. A device for producing an airborne stream of ice crystals, said device comprising:

an elongated outer housing;

an elongated inner housing mounted within said outer housing, said housings defining therebetween an air passage having a venturi-shaped zone to cause a gradual increase of velocity of air flowing through said passage;

a fan in said outer housing, said fan generating a flow of air through said passage which egresses through an outlet end of said outer housing as a high velocity air stream;

a water nozzle for spraying a diverging stream of water into said air stream; and a nucleator in an outlet end of said inner housing for spraying fine water droplets within said streams, said fine water droplets forming nuclei to induce ice crystals formation whereby, temperature permitting, water drops of said stream of water adhere to said nuclei to form ice crystals.

13. A device as defined in claim 12, wherein said outer housing includes a converging section.

14. A device as defined in claim 12, wherein said housings are of a generally tubular shape.

15. A device as defined in claim 12, wherein said fan is vaneaxial.

16. A device as defined in claim 15, further comprising guide vanes extending between said housings, said guide vanes cooperating with said fan to produce a substantially rectilinear air flow through said passage.

17. A device as defined in claim 16, wherein said guide vanes are located a short distance downstream from blades of aid fan, said guide vanes extending at least one half of the distance between said blades and the venturi-shaped zone.

18. A device as defined in claim 12, comprising a plurality of nucleators in said inner housing.

19. A device according to claim 18, including manifold means in the outlet end of said inner housing for separately receiving water and air under pressure, said manifold means carrying said water nozzle and said plurality of nucleators.

20. A device according to claim 19, wherein said manifold means includes a water manifold for receiving water under pressure and feeding the water to said plurality of nucleators and an air manifold for receiving air under pressure and feeding the air to said plurality of nucleators.

21. A device according to claim 20, wherein said manifold means includes a conduit extending through said water manifold and carrying said water nozzle on one end thereof, said conduit receiving water under pressure for discharge through said water nozzle and into said water manifold.

22. A device according to claim 21, wherein said manifold means includes a cylindrical wall coaxial with said conduit defining said water manifold, a pressure regulator outside said wall for receiving water from said conduit, and a return line for feeding water from said pressure regulator into said water manifold for distribution to said plurality of nucleators.

23. A device according to claim 12, further comprising a flaring nozzle mounted to an outlet end of said outer housing.

24. A device according to claim 12, wherein said outer housing includes a converging section contiguous with a flaring nozzle to form said venturi-shaped zone.

25. A device according to claim 12 wherein said water nozzle is mounted in said inner housing.

26. A device for producing an airborne stream of ice crystals, said device comprising:

an elongated outer housing;

an elongated inner housing mounted within said outer housing, said housings defining therebetween an air passage;

a fan in said outer housing, said fan generating a flow of air through said passage which egresses from an outlet end of said outer housing as a high velocity air stream;

a water nozzle for spraying a diverging stream of water into said air stream; and a nucleator in an outlet end of said inner housing for spraying fine water droplets within said streams, said fine water droplets forming nuclei to induce ice crystals formation, whereby, temperature permitting, water drops of said stream of water adhere to said nuclei to form ice crystals.

27. A device as defined in claim 26, wherein said air passage has a venturi-shaped zone causing a gradual increase of velocity of air flowing through said passage.

28. A device as defined in claim 27, wherein said fan is vaneaxial.

29. A device as defined in claim 28, further comprising guide vanes extending between said housings, said guide vanes cooperating with said fan to produce a substantially rectilinear air flow through said passage.

30. A device as defined in claim 29, wherein said guide vanes are located a short distance downstream from blades of said fan, said guide vanes extending at least one half of the distance between said blades and the venturi-shaped zone.

31. A device as defined in claim 27, wherein said outer housing includes a converging section.

32. A device according to claim 27, further comprising a flaring nozzle mounted to an outlet end of said outer housing.

33. A device according to claim 27, wherein said outer housing includes a converging section contiguous with a flaring nozzle to form said venturi-shaped zone.

34. A device as defined in claim 26, wherein said housings are of a generally tubular shape.

35. A device as defined in claim 26, comprising a plurality of nucleators in said inner housing.

36. A device according to claim 35, including manifold means in the outlet end of said inner housing for separately receiving water and air under pressure, said manifold means carrying said water nozzle and said plurality of nucleators.

37. A device according to claim 36, including manifold means in the outlet end of said inner housing for separately receiving water and air under pressure, said manifold means carrying said water nozzle and said plurality of nucleators.

38. A device according to claim 37, wherein said manifold means includes a water manifold for receiving water under pressure and feeding the water to said plurality of nucleators and an air manifold for receiving air under pressure and feeding the air to said plurality of nucleators.

39. A device according to claim 38, wherein said manifold means includes a conduit extending through said water manifold and carrying said water nozzle on one end thereof, said conduit receiving water under pressure for discharge through said water nozzle and into said water manifold.

40. A device according to claim 39, wherein said manifold means includes a cylindrical wall coaxial with said conduit defining said water manifold, a pressure regulator outside said wall for receiving water from said conduit, and a return line for feeding water from said pressure regulator into said water manifold for distribution to said plurality of nucleators.

41. A device according to claim 26 wherein said water nozzle is mounted in said inner housing.

42. A device for producing an airborne stream of ice crystals, said device comprising:

an elongated outer housing;

an elongated inner housing mounted within said outer housing, said housing defining therebetween an air passage having a venturi-shaped zone to cause a gradual increase of velocity of air flowing through said passage;

a fan in said outer housing, said fan generating a flow of air through said passage which egresses from an outlet end of said outer housing as a high velocity air stream;

a water nozzle for spraying a diverging stream of water into said air stream; and a nucleator for spraying fine water droplets within said streams, said fine water droplets forming nuclei to induce ice crystals formation whereby, temperature permitting, water drops of said stream of water adhere to said nuclei to form ice crystals.

43. A device as defined in claim 42, wherein said nucleator is mounted in an outlet end of said inner housing.

44. A device as defined in claim 43, comprising a plurality of nucleators mounted in an outlet end of said inner housing.

45. A device according to claim 44, including manifold means in the outlet end of said inner housing for separately receiving water and air under pressure, said manifold means carrying said water nozzle and said plurality of nucleators.

46. A device according to claim 45, wherein said manifold means includes a water manifold for receiving water under pressure and feeding the water to said plurality of nucleators and an air manifold for receiving air under pressure and feeding the air to said plurality of nucleators.

47. A device according to claim 46, wherein said manifold means includes a conduit extending through said water manifold and carrying said water nozzle on one end thereof, said conduit receiving water under pressure for discharge through said water nozzle and into said water manifold.

48. A device according to claim 47, wherein said manifold means includes a cylindrical wall coaxial with said conduit defining said water manifold, a pressure regulator outside said wall for receiving water from said conduit, and a return line for feeding water from said pressure regulator into said water manifold for distribution to said plurality of nucleators.

49. A device a s defined in claim 42, wherein said fan is vaneaxial.

50. A device as defined in claim 49, further comprising guide vanes extending between said housings, said guide vanes cooperating with said fan to produce a substantially rectilinear air flow through said passage.

51. A device as defined in claim 50, wherein said guide vanes are located a short distance downstream from blades of said vaneaxial fan, said guide vanes extending at least one half of the distance between said blades and the venturi-shaped zone.

52. A device as defined in claim 42, wherein said outer housing includes a converging section.

53. A device according to claim 52, wherein said outer housing includes a flaring nozzle mounted to an outlet end thereof.

54. A device as defined in claim 42, wherein said housings are of a generally tubular shape.

55. A device according to claim 42, wherein said outer housing includes a flaring nozzle mounted to an outlet end thereof.

56. A device according to claim 42 wherein said water nozzle is mounted in said inner housing.

* * * * *